US009587404B1

(12) United States Patent
Franco

(10) Patent No.: US 9,587,404 B1
(45) Date of Patent: Mar. 7, 2017

(54) OPERABLE RAMP

(71) Applicant: George Franco, Riverbank, CA (US)

(72) Inventor: George Franco, Riverbank, CA (US)

(73) Assignee: Lift-U, Division of Hogan Mfg., Inc., Escalon, CA (US)

( * ) Notice: Subject to any disclaimer, the term of this patent is extended or adjusted under 35 U.S.C. 154(b) by 0 days.

(21) Appl. No.: 15/133,127

(22) Filed: Apr. 19, 2016

(51) Int. Cl.
*E04F 11/00* (2006.01)

(52) U.S. Cl.
CPC ..... *E04F 11/002* (2013.01)

(58) Field of Classification Search
CPC ..... E04F 2011/005; E04F 2011/007; E04F 2011/0203; E04F 11/02; E04F 11/062; E04F 11/1041
USPC ..... 52/183; 187/200; 14/71.3; 414/921
See application file for complete search history.

(56) References Cited

U.S. PATENT DOCUMENTS 3,955,827 A * 5/1976 Wonigar ..... B60R 3/02 105/445
4,027,807 A 6/1977 Thorley
4,081,091 A 3/1978 Thorley
4,124,099 A * 11/1978 Dudynskyj ..... B60P 1/4414 280/166
4,164,292 A 8/1979 Karkau
4,180,366 A * 12/1979 Roth ..... B60P 1/4457 105/447
4,251,179 A * 2/1981 Thorley ..... B60P 1/4421 105/430
4,270,630 A 6/1981 Karkau
5,316,432 A * 5/1994 Smalley ..... B60R 3/02 187/200
5,454,196 A 10/1995 Gaines et al.
6,082,751 A * 7/2000 Hanes ..... B60R 3/02 280/163
6,484,344 B1 11/2002 Cooper
6,558,106 B2 * 5/2003 Sardonico ..... B60P 1/445 254/10 R
6,764,123 B1 7/2004 Bilyard
8,631,529 B1 1/2014 Johnson et al.
8,739,342 B1 6/2014 Johnson et al.
8,813,290 B1 * 8/2014 Morris ..... E04F 11/002 14/71.3
8,832,893 B1 * 9/2014 Morris ..... B66B 9/08 14/71.3
8,887,337 B1 11/2014 Morris et al.
(Continued)

*Primary Examiner* — Gary Hartmann
(74) *Attorney, Agent, or Firm* — Christensen O'Connor Johnson; Matthew Balint

(57) ABSTRACT

An operable ramp is moveable between a raised (step) position and a lowered (ramp) position. The operable ramp includes a first panel rotatably coupled about a first axis, the first axis that moves back and forth as the operable ramp reciprocates between the raised and lowered positions. A second panel is rotatably coupled to the first panel and extends downward from the first panel in the raised position. The second panel also rotates about a fixed second axis. The first and second panels cooperate to provide an inclined surface when the operable ramp is in the lowered position. A linkage selectively rotates the first panel about the first axis. The operable ramp further includes a third panel rotatable about a fixed third axis. The third provides a surface between the first panel and a fixed panel when the operable ramp is in the raised position.

14 Claims, 10 Drawing Sheets

(56) References Cited

U.S. PATENT DOCUMENTS

| | | | | |
|---|---|---|---|---|
| 8,918,939 | B1 * | 12/2014 | Morris | E04F 11/002 14/71.1 |
| 8,925,131 | B1 * | 1/2015 | Morris | E04F 11/002 14/71.3 |
| 8,943,631 | B1 * | 2/2015 | Morris | B66B 9/08 14/71.3 |
| 9,045,908 | B1 * | 6/2015 | Morris | E04F 11/002 |

* cited by examiner

OPERABLE RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress.

Installing a fixed ramp is a common way to provide the physically challenged with access to a building with one or more steps at the entrance. Fixed ramps take up a large amount of space and often detract from the aesthetic qualities of the building. Fold out ramps, similar to those used in vehicles can be utilized, but deployment often requires a large area into which the ramp deploys. Accordingly, there is a need for a ramp that provides access to a building with a step at the entrance, while minimizing the space required by the ramp.

SUMMARY

In a first representative embodiment according to the present disclosure, an operable ramp is moveable between a raised (step) position and a lowered (ramp) position. The operable ramp includes a first panel rotatably coupled about a first axis, the first axis that moves back and forth as the operable ramp reciprocates between the raised and lowered positions. A second panel is rotatably coupled to the first panel and extends downward from the first panel in the raised position. The second panel also rotates about a fixed second axis. The first and second panels cooperate to provide an inclined surface when the operable ramp is in the lowered position. A linkage selectively rotates the first panel about the first axis. The operable ramp further includes a third panel rotatable about a fixed third axis. The third panel provides a surface between the first panel and a fixed panel when the operable ramp is in the raised position.

A second representative embodiment according to the present disclosure is an operable ramp moveable between a raised (step) position and a lowered (ramp) position. A first panel is rotatably coupled at a first end about a first axis. When the operable ramp moves toward the lowered position, the first axis moving in a first direction, and when the operable ramp moves toward the raised position, the first axis moves in a second direction. A second panel is rotatably coupled at a first end to a second end of the first panel and extends downward from the first panel in the raised position. The second panel rotates about a fixed second axis when the operable ramp moves from the raised position to the lowered position. In the lowered position, the first panel and the second panel cooperate to provide an inclined surface. The operable ramp further includes a third panel rotatably associated with a fixed fourth panel, wherein the third panel provides a surface between the first panel and a fourth panel.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Likewise, unless otherwise noted, any steps described herein are not limited to a particular order, such that steps may be rearranged in some instances to achieve the same or substantially similar result.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "upper," "lower," "inner," "outer," "left," "right," etc. These references, and other similar directional references in the present application, are only to assist in helping describe and to understand the particular embodiment and are not intended to limit the present disclosure to these directions or locations.

Figure 1:
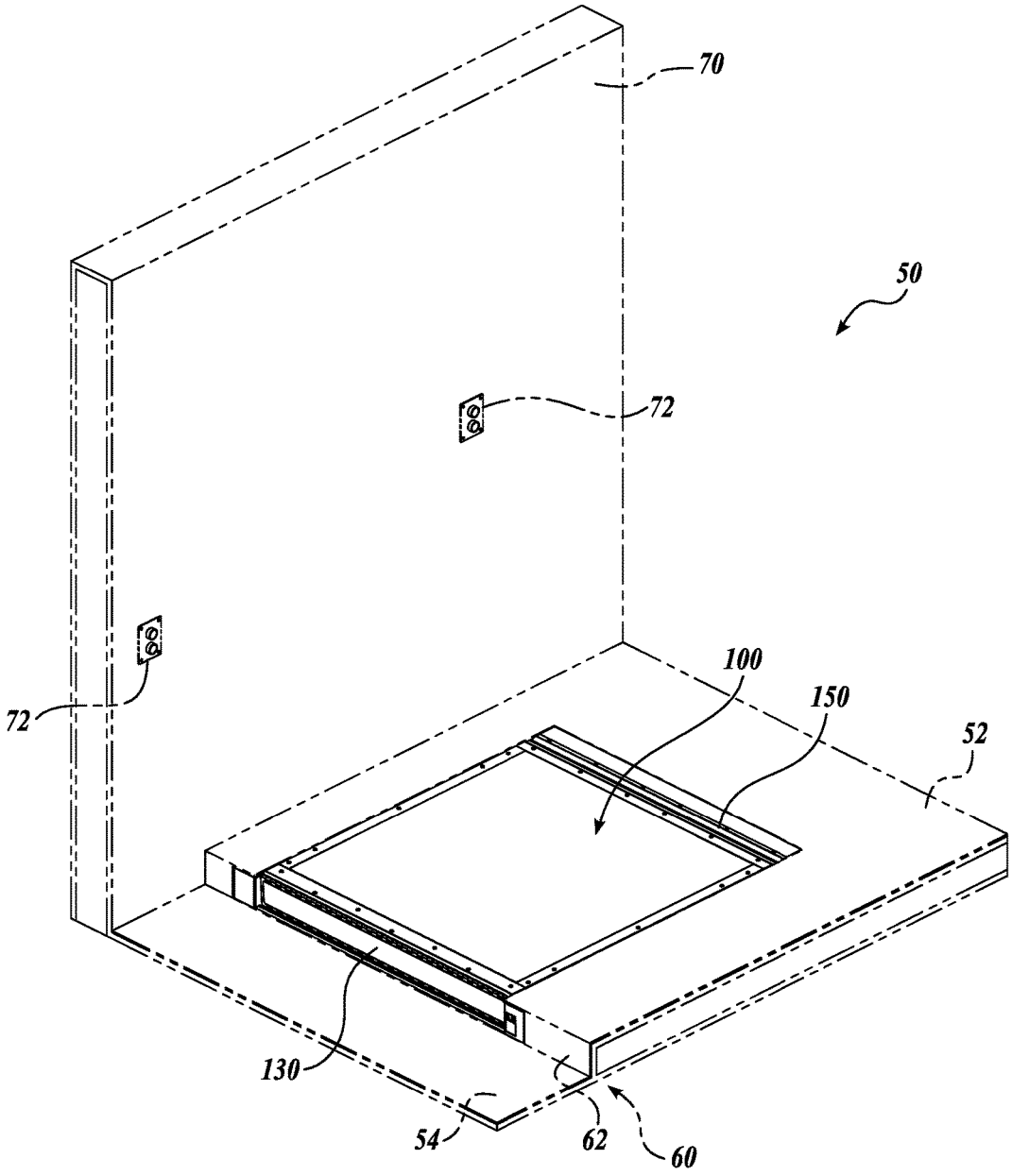
FIG. 1 shows a front isometric view of an exemplary embodiment of an operable ramp installed in a step, wherein the operable ramp is in a raised position.
Figure 2:
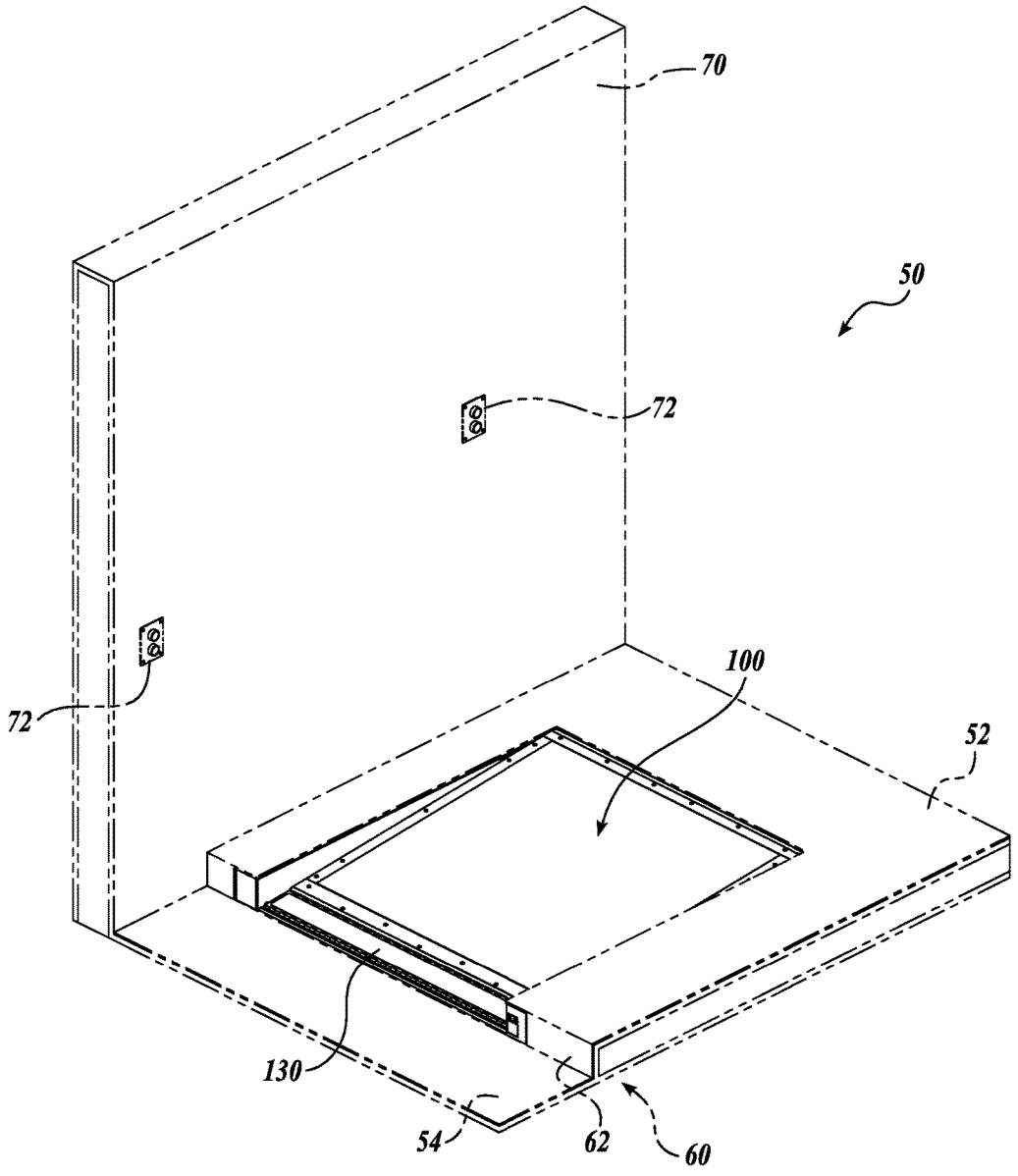
FIG. 2 shows a front isometric view of the operable ramp of FIG. 1 in a lowered position.
Figure 3:
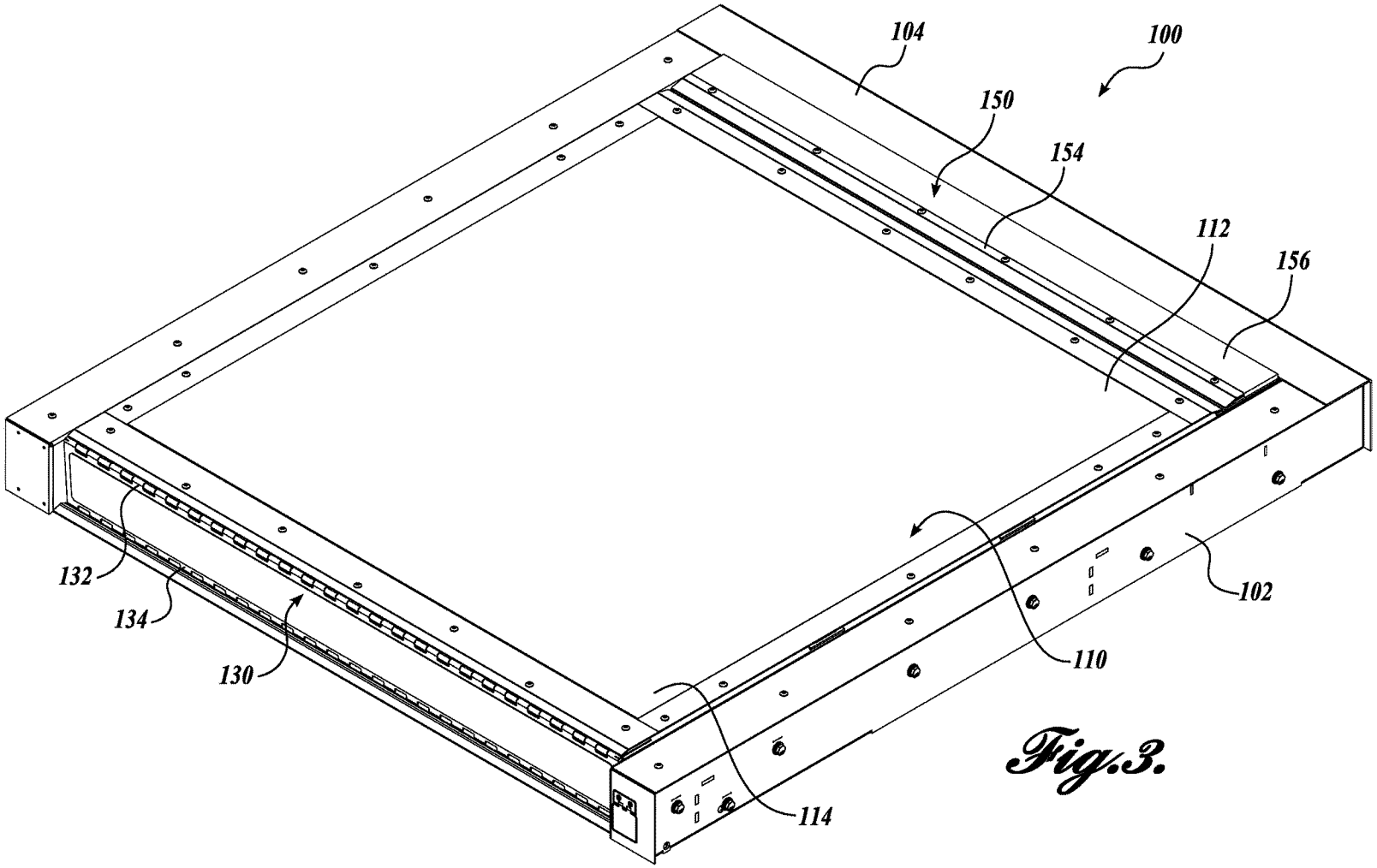
FIG. 3 shows a front isometric view of the operable ramp of FIG. 1 in the raised position.
Figure 4:
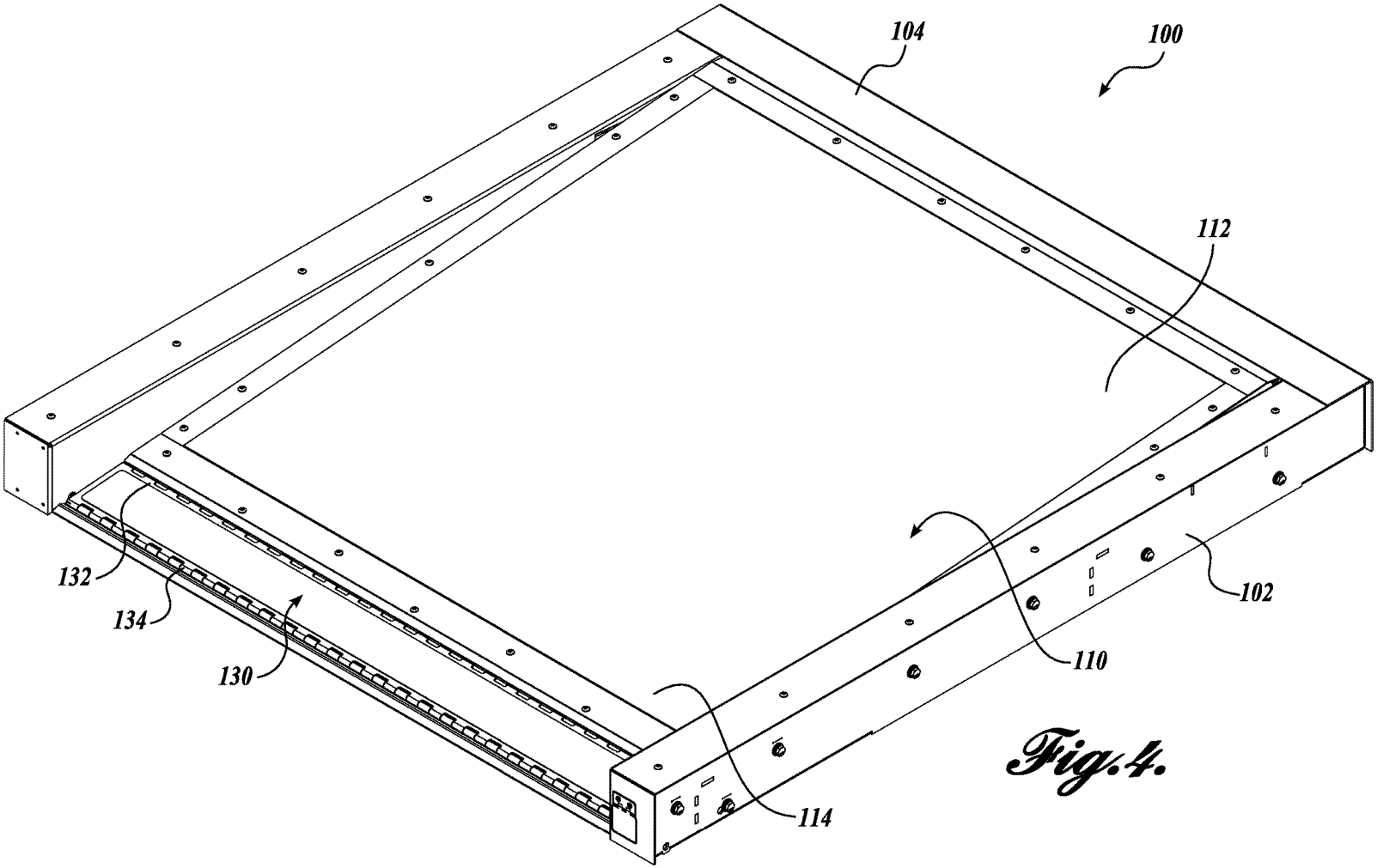
FIG. 4 shows a front isometric view of the operable ramp of FIG. 3 in the lowered position.

FIGS. 1-4 show an exemplary embodiment of an operable ramp 100. More specifically, FIGS. 1 and 2 show the operable ramp 100 installed in an architectural setting 50, and FIGS. 3 and 4 show the same embodiment in isolation, i.e., not installed. Referring to FIGS. 1 and 2, the architectural setting 50 includes a step 60 with a vertical riser 62 that provides a transition between an upper surface 52 and a lower surface 54. The illustrated setting 50 also includes a wall 70 upon which multiple controls 72 are mounted to allow an operator to operate the operable ramp 100 from both the upper surface and the lower surface. It will be appreciated that the illustrated installation of the operable ramp 100 is exemplary only and should not be considered limiting. In this regard, the operable ramp 100 can be installed in any number of architectural settings having a step that would present an obstacle for a physically challenged person. Further, the type and location of the controls 72 is not limited to the illustrated embodiment, but can include any suitable control configuration.

The operable ramp 100 includes a first panel 110 coupled at a first (outer) end 114 to a second panel 130. A second (inner) end 112 of the first panel 110 is positioned proximate to a third panel 150. FIGS. 1 and 3 show the operable ramp 100 in a raised position. In the raised position, the operable ramp 100 forms a step such that the first panel 110 and third panel 150 are generally horizontal and flush with the upper surface 52, and the second panel 130 extends downward from the outer end 114 of the first panel 110 to the lower surface 54. Thus, the first and third panels 110 and 150 cooperate to act as a tread, and the second panel 130 forms a riser when the operable ramp 100 is in the raised position. When the operable ramp 100 is in the lowered position of FIGS. 2 and 4, the first panel 110 slopes downward from its inner end 112 to the upper end 132 of the second panel 130, which slopes downward from its upper end 132 to the lower surface 54. Thus, the first panel 110 and second panel 130 cooperate to provide a transition surface that extends from the upper surface 52 to the lower surface 54 when the operable ramp 100 is in the lowered (ramp) position.

As best shown in FIGS. 3 and 4, the operable ramp 100 includes a frame 102. The frame provides a structure with a fixed position to which the components of the operable ramp 100 are attached. To install the operable ramp 100 in an architectural setting, the frame 102 is attached to surrounding structure to secure the operable ramp in place. Although the illustrated embodiments of the operable ramp include a frame 102, other embodiments are contemplated in which the operable ramp 100 does not include a frame. To install such embodiments in architectural settings, the operable ramp 100 components are attached directly to the surrounding structure or to suitable structure within the building, thus making a frame 102 unnecessary. Accordingly, embodiments of the described operable ramp 100 that do not include a frame 102 should be considered within the scope of the present disclosure.

Referring now to FIGS. 3, 4, 7, and 8, the first panel 110 is a generally rectangular panel formed of known materials to have suitable strength and durability such that the panel can withstand user traffic in both the raised (step) and lowered (ramp) positions. In one exemplary embodiment, the first panel 110 is formed from one or more pieces of sheet metal (such as aluminum or steel), with a plurality of stiffeners 116 and 118 attached to the bottom of the panel to provide additional stiffness. A texture is preferably formed integrally with or applied to the upper surface of the first panel 110 to provide increased traction.

The outer end 114 of the first panel 110 is rotatably coupled to the upper end 132 of the second panel 130 about an axis 400 with a hinge or other suitable structure. Similar to the first panel 110, the second panel 130 is constructed of well-known materials having suitable strength and durability to withstand user traffic in both the raised (step) and lowered (ramp) positions. The lower end 134 of the second panel 130 is rotatably coupled with a hinge or other suitable structure to the frame 102 about an axis 402 that is parallel to axis 400.

Figure 11:
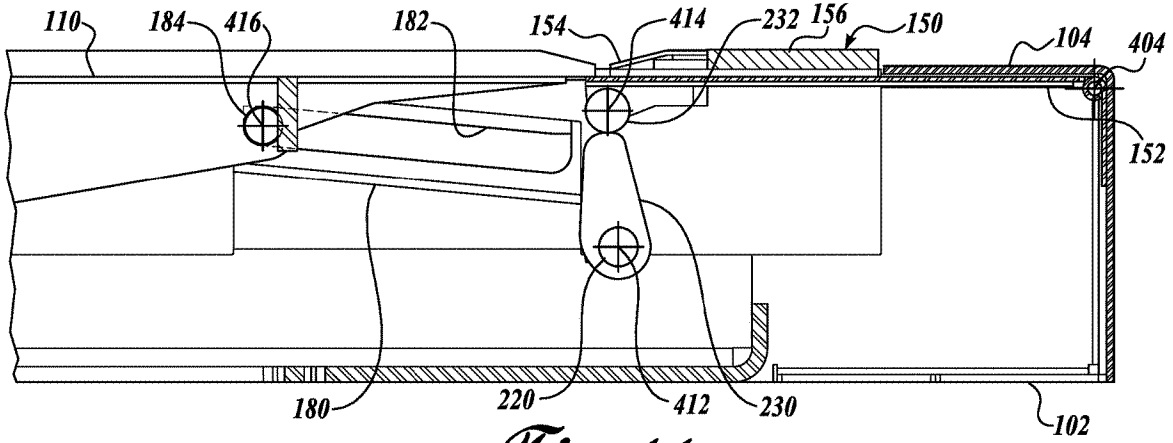
FIG. 11 shows a partial cutaway side view of a an inner end of the operable ramp of FIG. 7 with the operable ramp in the raised position.
Figure 12:
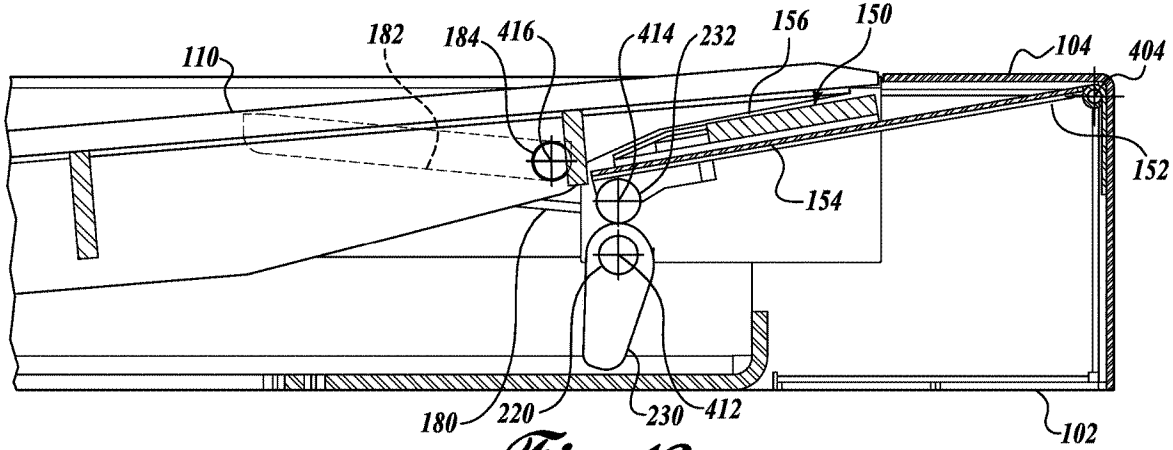
FIG. 12 shows a partial cutaway side view of the inner end of the operable ramp of FIG. 11 with the operable ramp in the lowered position.

Referring to FIGS. 11 and 12, a bearing element 184 is coupled to each side of the inner end 112 of the first panel 110 such that a bearing element extends laterally from each side of the first panel. In the illustrated embodiment, the bearing element 184 is a roller bearing rotatably coupled to the first panel 110 about axis 416.

A guide 180 is coupled to each side of the frame 102 at the inner end of the operable ramp 100. An elongate slot 182 is formed in each guide 180. Each elongate slot 182 receives one of the bearing elements 184 such that the bearing elements 184 are disposed within the elongate slots 182. As the operable ramp 100 reciprocates between the raised and lowered positions, the bearing elements 184 move along the elongate slots 182 to support the inner end of the first panel 110. Although the bearing elements 184 are illustrated as roller bearings, alternate bearing elements, such as protrusions with fixed bearing surfaces are contemplated and should be considered within the scope of the present disclosure.

Still referring to FIGS. 11 and 12, the third panel 150 is rotatably coupled at an inner end 152 to the frame 102 about an axis 404. A bearing element 232 is coupled to the lower side of the outer end 154 of the third panel 150 about axis 414, and a cam 230 is rotatably mounted to the frame 102 about axis 412. In the illustrated embodiment, bearing element 232 and corresponding cam 230 is located at each side of the operable ramp 100; however, alternate embodiments are contemplated in which the number and location of bearing elements and cams vary, and such variations should be considered within the scope of the present disclosure. Further, while the bearing element 232 is illustrated as a roller bearing, an alternate bearing element surface suitable for use as a cam follower can be utilized and should be considered within the scope of the present disclosure.

The cam 230 contacts and supports the bearing element 232 and, therefore, the outer end 154 of the third panel 150. As the cam 230 is rotated about axis 412, the bearing element 232 maintains contact with the cam. The cam 230, itself, is shaped so that selective rotation of the cam 230 moves the outer end 154 of the third panel 150 between the raised position of FIG. 11 and the lowered position of FIG. 12.

As best shown in FIG. 11, when the operable ramp 100 is in the raised position, the third panel 150 has an inner portion at least partially disposed beneath a fixed portion 104 (panel) of the frame 102. An outer portion of the third panel 150 has an upper surface 156 that extends horizontally between the fixed portion 104 of the frame 102 to the inner end 112 of the first panel 110.

When the operable ramp 100 is in a lowered position, as shown in FIG. 12, the cam 230 has rotated to lower the bearing element 232. As the bearing element 232 is lowered, the third panel 150 rotates about axis 404 to lower the outer end 154 of the third panel.

Referring now to FIGS. 5, 6, 9, and 10, the operable ramp 100 includes a drive assembly 200 to selectively reciprocate the operable ramp between the raised position and the lowered position. In the disclosed embodiment, the drive assembly 200 includes a motor 202 disposed below the first panel 110. The motor 202 is operably coupled to a first drive shaft 204 by a known transmission 206 so that the motor selectively rotates the drive shaft about a fixed axis 406.

A second drive shaft 220 is rotatably mounted to the frame 102 about axis 412, which is parallel to axis 406. The second drive shaft 220 is coupled to the first drive shaft 204 by a pair of sprockets 224 and 226 mounted to the first and second drive shafts, respectively, and a chain 222 forming a loop that engages both sprockets. The chain 222 couples the first and second drive shafts 204 and 220 so that rotation of the first drive shaft 204 by the motor 202 rotates the second drive shaft 220. It will be appreciated that the first and second drive shafts can be coupled in any suitable manner for synchronized rotation. Further, a separate motor can be utilized to rotate each drive shaft. Also, rotation of the first drive shaft does not need to correspond directly to rotation of the second drive shaft. For example, a deployment sequence could include rotating the second drive shaft and then rotating the first drive shaft, with little or no overlap between the rotations. These and other configurations and timing for rotating the drive shafts are contemplated and should be considered within the scope of the present disclosure.

Figure 9:
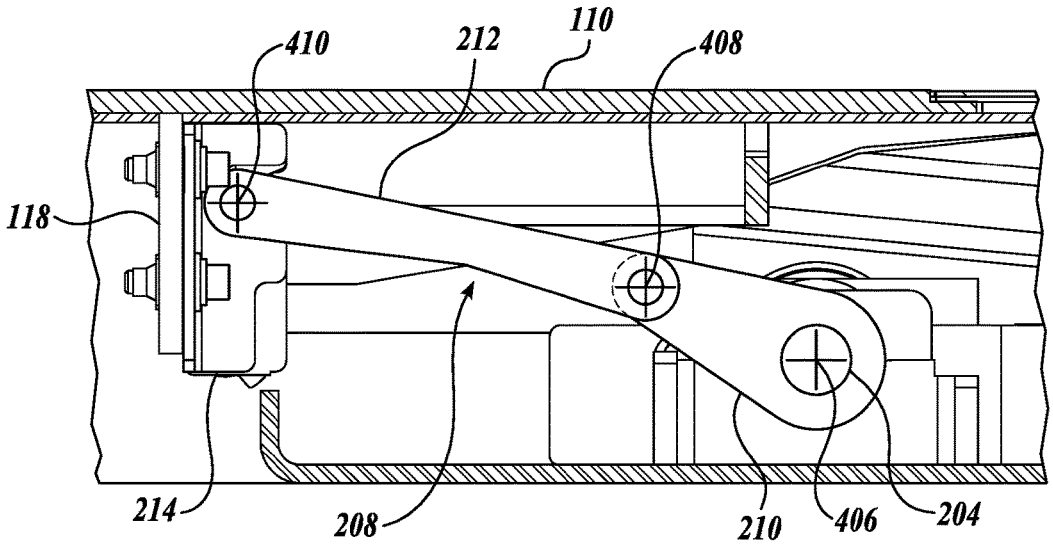
FIG. 9 shows a partial cutaway side view of a linkage of the operable ramp of FIG. 7 with the operable ramp in the raised position.
Figure 10:
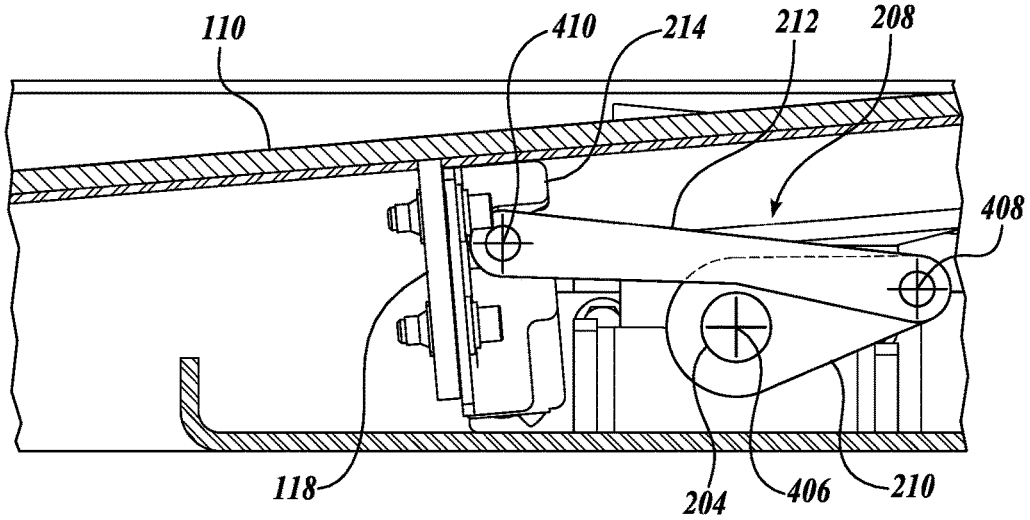
FIG. 10 shows a partial cutaway side view of the linkage of FIG. 9 with the operable ramp in the lowered position.

As best shown in FIGS. 9 and 10, the first drive shaft 204 is coupled to a first end of a drive link 210, which forms part of a linkage 208. Rotation of the drive shaft 204 rotates the drive link 210 about axis 406. A second end of the drive link 210 is rotatably coupled about axis 408 to one end of a slave link 212. A second end of the slave link 212 is rotatably coupled to the first panel 110 about an axis 410. In the illustrated embodiment, the slave link 212 is coupled to a linkage fitting 214 that is secured to a stiffener 118 located on the bottom of the first panel 110; however, it will be appreciated that any suitable configuration for rotatably coupling the slave link to the first panel 110 can be utilized and should be considered within the scope of the present disclosure.

Referring now to FIGS. 11 and 12, a cam 230 is fixedly coupled to each end of the second drive shaft 220. As previously discussed, the cam 230 supportingly engages a bearing element 232 mounted to the third panel 150 to support the outer end 154 of the third panel.

Figure 5:
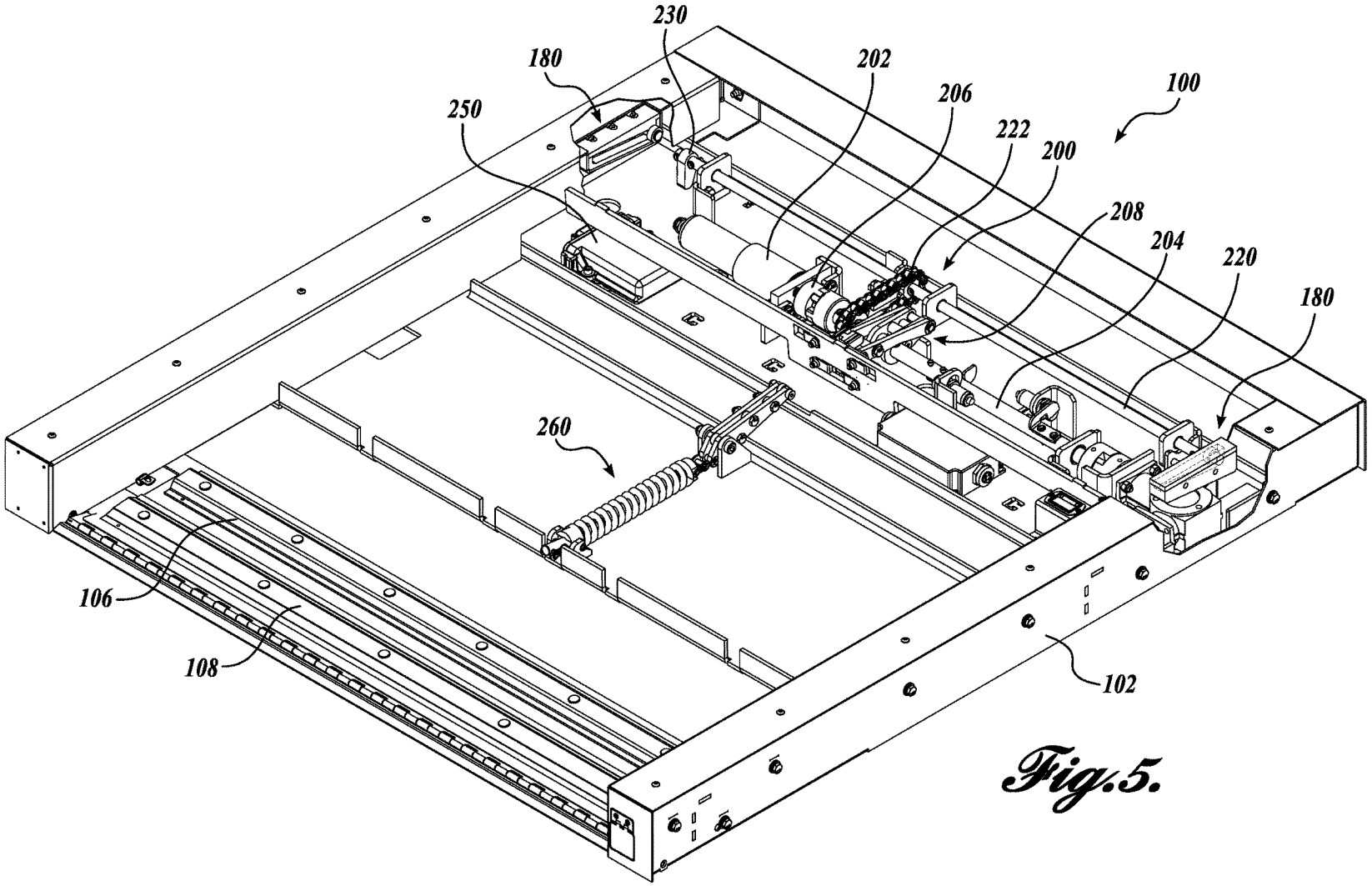
FIG. 5 shows a partially cutaway front isometric view of the operable ramp of FIG. 3 in the lowered position.
Figure 6:
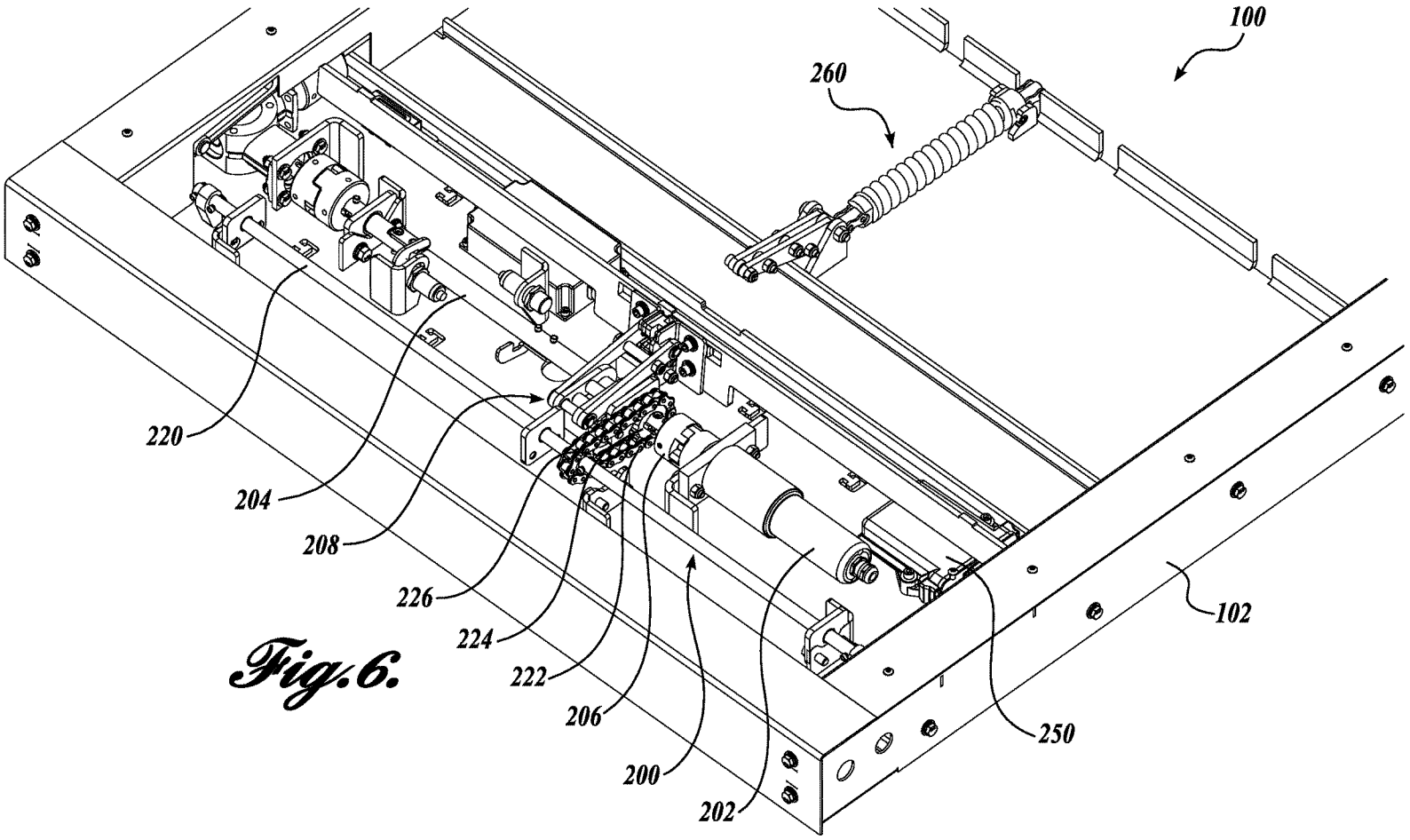
FIG. 6 shows a partially cutaway rear isometric view of the operable ramp of FIG. 3 in the lowered position.

As shown in FIGS. 5 and 6, a controller 250 is operably coupled to the motor 202. The controller 250 is operatively connected to the controls 72 so the controller can receive input from an operator and selectively controls the motor 202 to reciprocate the operable ramp 100 between the raised position and the lowered position. More specifically, the controller 250 controls the motor 202 to rotate the first drive shaft 204 and the second drive shaft 220 in a first direction to move the operable ramp 100 toward the lowered (ramp) position and in a second direction to move the operable ramp toward the raised (step) position.

It will be appreciated that a number of alternate drive assemblies 200 can be utilized to selectively rotate the first and second drive shafts 204 and 220 in first and second directions about axes 406 and 412, respectively. In one alternate embodiment, a linear actuator rotates the drive shaft rather than the disclosed motor with a rotary output. In another contemplated embodiment, the drive assembly 200 includes a counterbalance to reduce the force required to actuate the operable ramp 100, thereby decreasing the size of the motor. These and other configurations that selectively move the drive link 210 and cam surface in first and second directions are contemplated and should be considered within the scope of the present disclosure.

Figure 7:
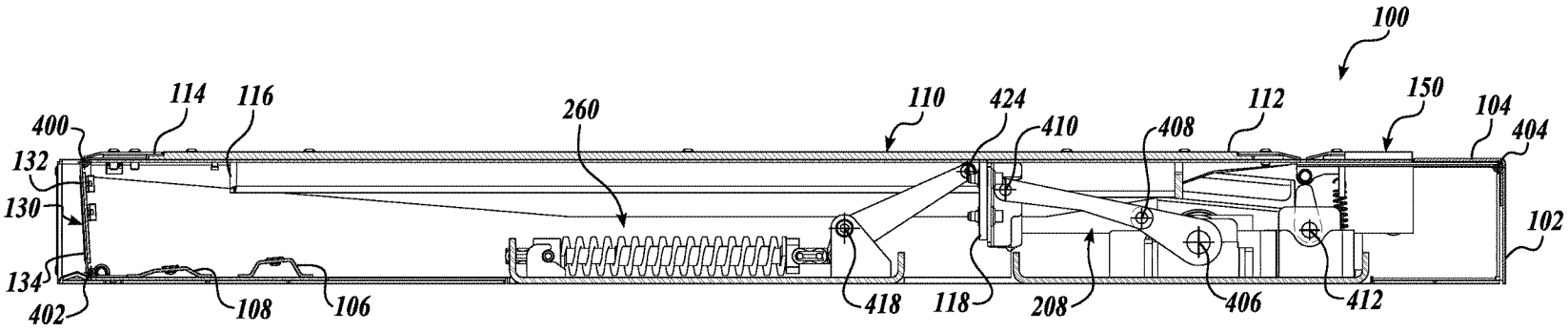
FIG. 7 shows a cutaway side view of the operable ramp of FIG. 3 in the raised position.

As shown in FIG. 7, when the operable ramp 100 is in the raised (step) position, the first panel 110 and third panel 150 provide a generally horizontal "tread" portion upon which able bodied persons can walk. The inner end 112 of the first panel 110 is supported by the engagement of the bearings 184 with the elongate slots 182 formed in the guide fittings 180. The upper surface 156 of the third panel 150 extends inwardly from the inner end 112 of the first panel 110 to the fixed panel 104 positioned at the inner portion of the frame 102 to provide a transition therebetween.

The second panel 130 extends downward from the outer end 114 of the first panel 110 to provide a "riser" to the step. The second panel 130 also supports the outer end 114 of the first panel 110 when the operable ramp 100 is in the raised position. In the illustrated embodiment, the axis 400 between the first and second panels 110 and 130 is offset from the axis 402 between the second panel and the frame 102. As a result, the weight of the first panel tends to rotate the second panel 130 counterclockwise as viewed in FIG. 7. In the event of a power outage or drive system failure, the second panel 130 will tend to rotate in the counterclockwise direction, but will be restrained by the first panel 110, the inner end 112 of which is restrained by the engagement of the bearings 184 with the elongate slots 182 formed in the guide fittings 180. In this manner, the operable ramp 100 is maintained in a raised position, even in the event of a power outage or drive system failure.

To move the operable ramp 100 from the raised position to the lowered position, the motor 202 rotates the drive shafts 204 and 220 in a first direction (clockwise as viewed in FIG. 7). The first drive shaft 204 rotates the drive link 210 about axis 406, which in turn drives the slave link 212. Movement of the slave link 212 drives the first panel 110 toward the fixed panel 104. As the first panel 110 moves toward the fixed panel 104, the outer end 114 of the first panel pulls the upper end 132 of the second panel 130 to rotate the second panel in the clockwise direction (as viewed in FIG. 7) about axis 402. As the second panel 130 rotates, axis 400 moves downward along an arcuate path, thereby lowering the outer end 114 of the first panel 110. Lowering the outer end 114 of the first panel 110 causes the first panel to rotate about axis 416 as the bearings 184 travel along elongate slots 182. The first and second panels 110 and 130 rotate until the operable ramp 100 reaches the lowered position of FIG. 8.

As the first panel 110 moves toward the fixed panel 104, the second drive shaft 220 rotates the cam 230 to lower the outer end 154 of the third panel 150. Thus, when the operable ramp 100 is in the lowered position of FIGS. 8 and 12, the third panel 150 is moved below the inner end 112 of the first panel 110.

When the operable ramp 100 is in the lowered position, the first panel 110 and second panel 130 are approximately parallel and cooperate to provide an inclined transition surface between the fixed panel 104 and the lower surface 54 shown in FIG. 3. Although the first and second panels 110 and 130 of the illustrated embodiment are approximately parallel in the lowered position, i.e., they form an angle of approximately 180° relative to each other, other embodiments are contemplated in which the first and second panels are not parallel in the lowered position. In this regard, embodiments are possible in which the first and second panels 110 and 130 form an angle in the range of 135° to 225°.

In the illustrated embodiment, the frame 102 includes first and second supports 106 and 108 formed at the bottom of the frame. The exemplary supports 106 and 108 are inverted C-channels, but any suitable support configuration can be utilized. The first and second supports 106 and 108 are sized and configured to supportingly engage the first panel 110 and second panel 130, respectively, when the operable ramp 100 is in the lowered position. That is, the first support 106 supports outer end 114 of the first panel 110, and the second support 108 supports to the upper end 132 of the second panel 130 when the ramp is in the lowered position. The supports 106 and 108 provide improved ramp stability, and also prevents a sudden drop of the first panel 110 in the event of a power outage or drive system failure. It will be appreciated that the position, shape, and location of the supports 106 and 108 can vary. Additional supports can also be utilized. These and other variations of the supports 106 and 108 should be considered within the scope of the present disclosure.

Figure 8:
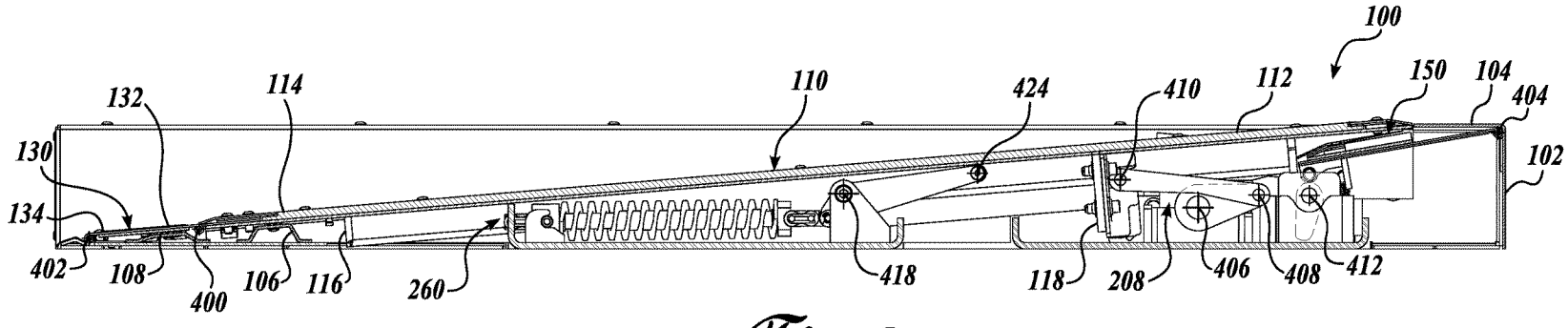
FIG. 8 shows a cutaway side view of the operable ramp of FIG. 7 in the lowered position.

To move the operable ramp 100 from the lowered position to the raised position, the motor 202 rotates the drive shafts 204 and 220 in a second direction (counterclockwise as viewed in FIG. 8). The first drive shaft 204 rotates the drive link 210 about axis 406, which in turn drives the slave link 212. Movement of the slave link 212 drives the first panel 110 away from the fixed panel 104. Movement of the inner end 112 of the first panel 110 is controlled by the translation of the bearings 184 along the elongate slots 182. Movement of the outer end 114 of the first panel 110 is controlled by the rotational attachment to the first panel to the second panel 130 about axis 400, which moves upward along an arcuate path as the second panel rotates counterclockwise about axis 402.

As the first panel 110 moves away from the fixed panel 104, the second drive shaft 220 rotates the cam 230 to raise the outer end 154 of the third panel 150. The third panel 150 is sized and configured to span the gap between the inner end 112 of the first panel 110 and the fixed panel 104. Thus, when the operable ramp 100 is in the raised position of FIGS. 7 and 11, the upper surface 156 of the third panel 150 provides a transition surface between the first panel 110 and the fixed panel 104.

Rotation of the drive link 210 continues until the operable ramp 100 reaches the raised position of FIG. 7. In the raised position, the first panel 110 and third panel 150 cooperate to form a surface upon which able body persons can walk, and the second panel 130 extends downward from the outer end 114 of the first panel 110. Thus, the operable ramp 100 acts as a step between the upper surface 52 and the lower surface 54 of FIGS. 1 and 2.

In order to reduce the size of the actuating force required from the motor 202 and to reduce wear and tear on the drive assembly 200 components in general, the operable ramp 100 includes a counterbalance 260 disposed below the first panel 110. The counterbalance 260 applies an upward force $F_C$ to the bottom of the first panel 100 to counteract at least a portion of the weight of the ramp panels. In doing so, the counterbalance allows for the use of a smaller, more compact motor 202 and prolongs the life of the drive assembly 200.

Figure 13:
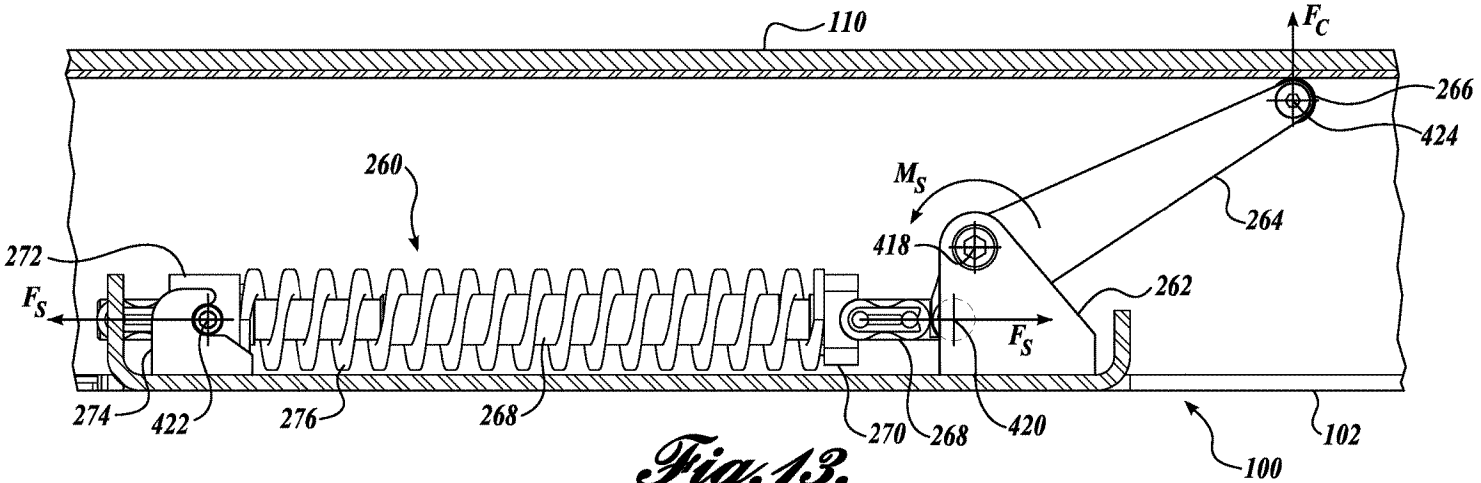
FIG. 13 shows a partial cutaway side view of a counterbalance of the operable ramp of FIG. 7 with the operable ramp in the raised position.
Figure 14:
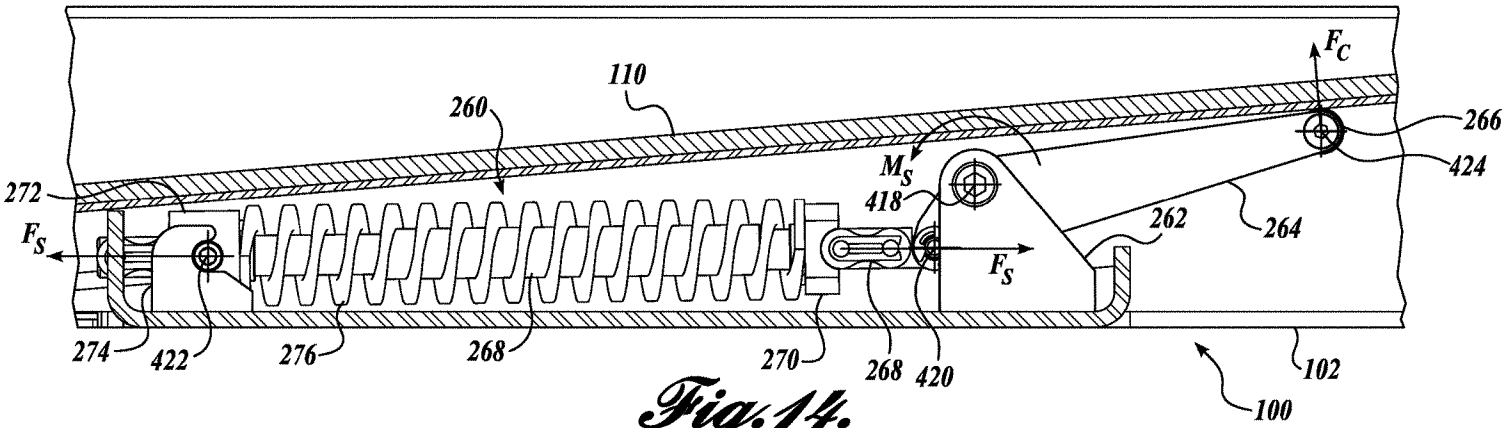
FIG. 14 shows a partial cutaway side view of the counterbalance of FIG. 13 with the operable ramp in the lowered position.

As shown in FIGS. 13 and 14, the counterbalance 260 includes a fitting 262 coupled to the frame 102 or other suitable structure below the first panel 110. A link 264 is rotatably coupled the fitting 262 about axis 418. A first end of the link 264 has a roller bearing 266 rotatably coupled to the link about axis 424. The roller bearing 266 rollingly or slidingly engages a lower surface of the first panel 110. In contemplated alternate embodiments a static bearing surface or other suitable bearing element or surface is disposed at the end of the link and slidingly or rollingly engages the first panel.

A rod 268 is rotatably coupled to a second end of the link 264 about axis 420 so that rotation of the link 264 rotates the end of the rod about axis 418. A biasing element 270 in the form of a cylindrical fitting is fixedly coupled to the rod 268 proximate to the link 264. A spring fitting 272 is slidably coupled to the rod 268 opposite the biasing element 270. The spring fitting 272 is rotatably coupled to a mounting fitting 274 about axis 422. The mounting fitting 274 is secured to the frame 102 or some other suitable fixed structure.

A spring 276 is disposed between the biasing element 270 and the spring fitting 272. In the illustrated embodiment, the spring 276 is a compression spring positioned such that the rod 268 extends through the coils of the spring. The spring 276 engages the biasing element 270 and the spring fitting 272, which are configured such that the ends of the spring are restrained thereby. The spring 276 is sized and configured to have a preload that is reacted by the biasing element 270 and the spring fitting 272. The spring fitting 272 is rotatably coupled to the mounting fitting 274 and, therefore, the spring force $F_S$ applied to the spring fitting by one end of the spring 276 is reacted out through the mounting fitting. The spring force $F_S$ applied to the biasing element 270 at the other end of the spring 276 is reacted out through the rod 268 by virtue of its fixed connection to the biasing element. As a result, the spring force $F_S$ is applied to the link 264 through axis 420.

The spring force $F_S$ applied to the link 264 results in a moment $M_S$ about axis 418. The moment $M_S$ is reacted through roller bearing 266 into a lower surface of the first panel 110. That is, the roller bearing 266 applies a counterbalance force $F_C$ to the first panel 110. The counterbalance force $F_C$ is applied normal to the lower surface of the first panel 110 and biases the first panel and, therefore, the operable ramp 100 toward the raised position.

When the operable ramp 100 moves from the raised position to the lowered position, link 264 rotates in a clockwise direction, as viewed in FIGS. 13 and 14. This rotation moves the biasing element 270 toward the spring fitting 272, thereby compressing the spring 276, which increases the spring force $F_S$. The magnitude of the moment arm between axis 418 and the line of action of spring force $F_S$ does not change appreciably between the raised and lower position, so the magnitude of the moment $M_S$ increases as the operable ramp 100 moves toward the lowered position due to the spring compression. At the same time, the moment arm between axis 418 and the line of action of counterbalance force $F_C$ increases as the operable ramp moves toward the lowered position. As a result, the counterbalance force $F_C$ tends to decrease as the operable ramp moves toward the lowered position.

It will be appreciated that the counterbalance 270 can be configured to provide a desired counterbalance force $F_C$ throughout the motion of the ramp. In this regard, the spring preload, spring constant k of the spring, the magnitude and variation of the moment arm throughout the travel of the operable ramp, as well as other factors can be modified to provide a desired performance curve. Further, multiple springs, various other types of springs, such as torsion springs, extension springs, non-linear springs, gas springs, etc., may be employed to provide a particular counterbalancing profile. These and other alternate configurations that provide a biasing force can be implemented and should be considered within the scope of the present disclosure.

While illustrative embodiments have been illustrated and described, it will be appreciated that various changes can be made therein without departing from the spirit and scope of the invention.

The embodiments of the invention in which an exclusive property or privilege is claimed are defined as follows:

1. An operable ramp moveable between a raised position and a lowered position, the operable ramp forming a step in the raised position, the operable ramp comprising:

(a) a first panel rotatably coupled at a first end about a first axis, the first axis moving in a first direction when the operable ramp moves toward the lowered position and in a second direction when the operable ramp moves toward the raised position;

(b) a second panel rotatably coupled at a first end to a second end of the first panel, the second panel extending downward from the first panel in the raised position and rotating about a fixed second axis when the operable ramp moves from the raised position to the lowered position, the first panel and the second panel cooperating to provide an inclined surface when the operable ramp is in the lowered position;

(c) a linkage operably coupled to the first panel, the linkage selectively rotating the first panel about the first axis; and (d) a third panel rotatably coupled at a first end about a fixed third axis, the third panel being rotatable about the third axis between a raised position when the operable ramp is in the raised position and a lowered position when the operable ramp is in the lowered position, the third panel providing a surface between the first panel and a fixed panel when the operable ramp is in the raised position.

2. The operable ramp of claim 1, further comprising a selectively rotatable cam supporting a second end of the third panel.

3. The operable ramp of claim 2, wherein rotation of the cam lowers the second end of the third panel when the operable ramp moves from the raised position to the lowered position.

4. The operable ramp of claim 1, wherein the third panel is partially disposed below the fixed panel.

5. The operable ramp of claim 1, wherein the third panel is partially disposed below the first panel when the operable ramp is in the lowered position.

6. The operable ramp of claim 1, wherein a second end of the third panel is disposed below the first end of the first panel when the operable ramp is in the lowered position.

7. The operable ramp of claim 5, wherein a second end of the third panel is positioned laterally from the first end of the first panel when the operable ramp is in the raised position.

8. The operable ramp of claim 1, the linkage comprising a first link selectively rotatable in a first direction and a second direction.

9. The operable ramp of claim 1, further comprising a guide having an elongate slot, the first end of the first panel slidingly engaging the elongate slot.

10. An operable ramp moveable between a raised position and a lowered position, the operable ramp forming a step in the raised position, the operable ramp comprising:

(a) a first panel rotatably coupled at a first end about a first axis, the first axis moving in a first direction when the operable ramp moves toward the lowered position and in a second direction when the operable ramp moves toward the raised position;

(b) a second panel rotatably coupled at a first end to a second end of the first panel, the second panel extending downward from the first panel in the raised position and rotating about a fixed second axis when the operable ramp moves from the raised position to the lowered position, the first panel and the second panel cooperating to provide an inclined surface when the operable ramp is in the lowered position; and (c) a third panel rotatably associated with a fixed fourth panel, the third panel providing a surface between the first panel and a fourth panel.

11. The operable ramp of claim 10, further comprising a cam supporting one end of the third panel, the cam rotating to lower the one end of the third panel when the operable ramp moves toward the lowered position.

12. The operable ramp of claim 10, at least a portion of the third panel being disposed beneath the fourth panel when the operable ramp is in the lowered position.

13. The operable ramp of claim 10, at least a portion of the third panel being disposed beneath the first panel when the operable ramp is in the lowered position.

14. The operable ramp of claim 10, further comprising a linkage operably coupled to the first panel, the linkage selectively rotating the first panel about the first axis.

* * * * *